US006739141B1

(12) United States Patent
Sienel et al.

(10) Patent No.: US 6,739,141 B1
(45) Date of Patent: May 25, 2004

(54) SUPERCRITICAL PRESSURE REGULATION OF VAPOR COMPRESSION SYSTEM BY USE OF GAS COOLER FLUID PUMPING DEVICE

(75) Inventors: Tobias H. Sienel, Manchester, CT (US); J. Michael Griffin, Fayetteville, NY (US)

(73) Assignee: Carrier Corporation, Syracuse, NY (US)

( * ) Notice: Subject to any disclaimer, the term of this patent is extended or adjusted under 35 U.S.C. 154(b) by 0 days.

(21) Appl. No.: 10/365,225

(22) Filed: Feb. 12, 2003

(51) Int. Cl.[7] ..... F25B 9/00
(52) U.S. Cl. ..... 62/87; 62/116
(58) Field of Search ..... 62/172, 513, 507, 62/116, 87; 621/183, 184, 228.3

(56) References Cited

U.S. PATENT DOCUMENTS

| | | | | | |
|---|---|---|---|---|---|
| 4,595,344 | A | * | 6/1986 | Briley | 417/185 |
| 5,245,836 | A | | 9/1993 | Lorentzen et al. | |
| 5,685,160 | A | | 11/1997 | Abersfelder et al. | |
| 5,769,610 | A | * | 6/1998 | Paul et al. | 417/228 |
| 6,272,871 | B1 | * | 8/2001 | Eisenhour | 62/225 |
| 6,276,153 | B1 | * | 8/2001 | Skupin et al. | 62/204 |
| 6,418,735 | B1 | * | 7/2002 | Sienel | 62/115 |
| 6,418,738 | B1 | * | 7/2002 | Yamashita | 62/183 |
| 6,430,949 | B2 | * | 8/2002 | Noro et al. | 62/183 |
| 6,484,519 | B1 | * | 11/2002 | Hesse et al. | 62/116 |
| 6,530,426 | B1 | * | 3/2003 | Kishita et al. | 165/202 |
| 6,584,796 | B2 | * | 7/2003 | Itoh et al. | 62/324.1 |
| 6,604,378 | B2 | * | 8/2003 | Clodic | 62/498 |
| 6,637,229 | B1 | * | 10/2003 | Forrest et al. | 62/230 |
| 6,647,742 | B1 | * | 11/2003 | Neiter et al. | 62/498 |

FOREIGN PATENT DOCUMENTS

| | | | |
|---|---|---|---|
| JP | 08238923 A | * | 9/1996 |
| JP | 10-019421 | | 1/1998 |
| JP | JP410038392 A | * | 2/1998 |
| JP | JP410166851 A | * | 6/1998 |
| WO | WO 99/08053 | | 2/1999 |
| WO | WO 99/34156 | | 7/1999 |

* cited by examiner

*Primary Examiner*—William E. Tapolcal
*Assistant Examiner*—Mohammad M. Ali
(74) *Attorney, Agent, or Firm*—Carlson, Gaskey & Olds

(57) ABSTRACT

Refrigerant is circulated through a vapor compression system including a compressor, a gas cooler, an expansion device, and an evaporator. Preferably, carbon dioxide is used as the refrigerant. The expansion device is a work recovery device which extracts energy from the expansion process and is coupled with a fluid pumping device that cools the refrigerant flowing through the gas cooler. The fluid pumping device pumps fluid through the gas cooler at a flow rate related to the energy extracted from the expansion process. The system provides a self-controlling mechanism to regulate the pressure in the gas cooler. If the pressure in the gas cooler increases, more energy is extracted from the expansion process, increasing the flowrate of the fluid pumping device, and decreasing the pressure of the refrigerant in the gas cooler. If the pressure in the gas cooler decreases, less energy is extracted from the expansion process, decreasing the flowrate of the fluid pumping device, and increasing the pressure of the refrigerant in the gas cooler.

18 Claims, 2 Drawing Sheets

SUPERCRITICAL PRESSURE REGULATION OF VAPOR COMPRESSION SYSTEM BY USE OF GAS COOLER FLUID PUMPING DEVICE

BACKGROUND OF THE INVENTION

The present invention relates generally to a system for regulating the high pressure component of a transcritical vapor compression system by employing an expander coupled to a fluid pumping device, such as a fan or a pump.

Chlorine containing refrigerants have been phased out in most of the world due to their ozone destroying potential. Hydrofluoro carbons (HFCs) have been used as replacement refrigerants, but these refrigerants still have high global warming potential. "Natural" refrigerants, such as carbon dioxide and propane, have been proposed as replacement fluids. Unfortunately, there are problems with the use of many of these fluids as well. Carbon dioxide has a low critical point, which causes most air conditioning systems utilizing carbon dioxide to run partially above the critical point, or to run transcritical, under most conditions. The pressure of any subcritical fluid is a function of temperature under saturated conditions (when both liquid and vapor are present). However, when the temperature of the fluid is higher than the critical temperature (supercritical), the pressure becomes a function of the density of the fluid.

When a vapor compression system is run transcritical, it is advantageous to regulate the high pressure component of the system. By regulating the high pressure of the system, the capacity and/or efficiency of the system can be controlled and optimized.

In the prior art, the high pressure component of a vapor compression system has been regulated by adjusting an expansion valve located at the exit of the gas cooler, allowing for control of system capacity and efficiency. Suction line heat exchangers and storage tanks have also been employed to increase system capacity and efficiency.

SUMMARY OF THE INVENTION

A transcritical vapor compression system includes a compressor, a gas cooler, an expansion device, and an evaporator. Refrigerant is circulated though the closed circuit system. Preferably, carbon dioxide is used as the refrigerant. As carbon dioxide has a low critical point, systems utilizing carbon dioxide as a refrigerant usually require the vapor compression system to run transcritical. When the system is run transcritical, it is advantageous to regulate the high pressure component of the system to control and optimize the capacity and/or efficiency of the system.

An expansion machine is a work recovery device which extracts energy from the expansion process. The amount of energy available for extraction by the expansion machine is generally proportional to the refrigerant pressure drop between the gas cooler and the evaporator.

The expansion device is coupled to a fluid pumping device that pumps the heat exchange fluid (typically air or water) through the gas cooler. The heat exchange fluid is used to cool the refrigerant in the gas cooler. The fluid pumping device pumps fluid through the gas cooler at a rate which is related to the amount of energy extracted from the expansion process.

The system provides a self-controlling mechanism to regulate the refrigerant pressure in the gas cooler. When the refrigerant pressure in the gas cooler increases, the refrigerant pressure drop between the gas cooler and the evaporator increases, and the expansion machine extracts more energy from the expansion process. As the energy increases, the flowrate of the fluid pumping device increases, increasing the effectiveness of the gas cooler and decreasing the pressure of the refrigerant in the gas cooler. When the refrigerant pressure in the gas cooler decreases, the refrigerant pressure drop between the gas cooler and the evaporator decreases, and the expansion machine extracts less energy from the expansion process. As the energy decreases, the flowrate of the fluid pumping device decreases, decreasing the effectiveness of the gas cooler and increasing the pressure of the refrigerant in the gas cooler

BRIEF DESCRIPTION OF THE DRAWINGS

The various features and advantages of the invention will become apparent to those skilled in the art from the following detailed description of the currently preferred embodiment. The drawings that accompany the detailed description can be briefly described as follows.

DETAILED DESCRIPTION OF THE PREFERRED EMBODIMENT

Figure 1:
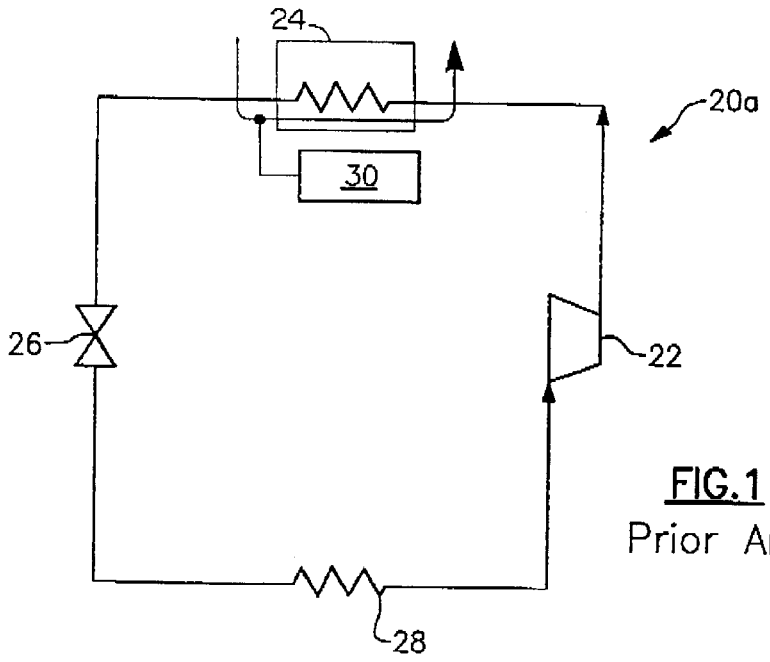
FIG.1 Prior Art
FIG. 1 illustrates a schematic diagram of a prior art vapor compression system.

FIG. 1 illustrates a prior art vapor compression system 20*a* including a compressor 22, a heat rejecting heat exchanger (a gas cooler in transcritical cycles) 24, an expansion device 26, and a heat accepting heat exchanger (an evaporator) 28.

Refrigerant circulates though the closed circuit cycle 20*a*. Preferably, carbon dioxide is used as the refrigerant. While carbon dioxide is illustrated, other refrigerants may be used. Because carbon dioxide has a low critical point, systems utilizing carbon dioxide as a refrigerant usually require the vapor compression system 20*a* to run transcritical. When the system 20*a* is run transcritical, it is advantageous to regulate the high pressure component of the system 20*a*. By regulating the high pressure of the system 20*a*, the capacity and/or efficiency of the system 20*a* can be controlled and optimized.

Figure 2:
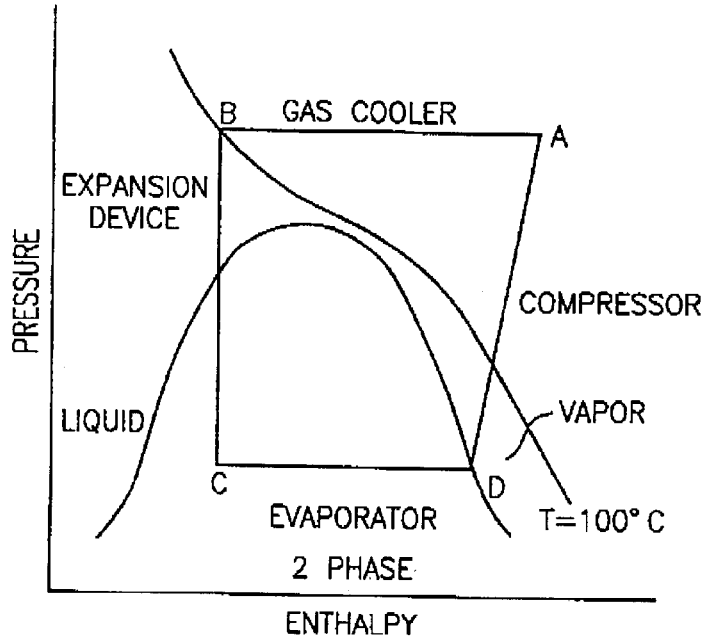
FIG. 2 illustrates a thermodynamic diagram of a transcritical vapor compression system.

The refrigerant exits the compressor 22 at high pressure and enthalpy, shown by point A in FIG. 2. As the refrigerant flows through the gas cooler 24 at high pressure, it loses heat and enthalpy to the heat exchanger fluid, exiting the gas cooler 24 with low enthalpy and high pressure, indicated as point B. As the refrigerant passes through the expansion valve 26, the pressure drops, shown by point C. After expansion, the refrigerant passes through the evaporator 28 and exits at a high enthalpy and low pressure, represented by point D. After the refrigerant passes through the compressor 22, it is again at high pressure and enthalpy, completing the cycle.

Figure 3:
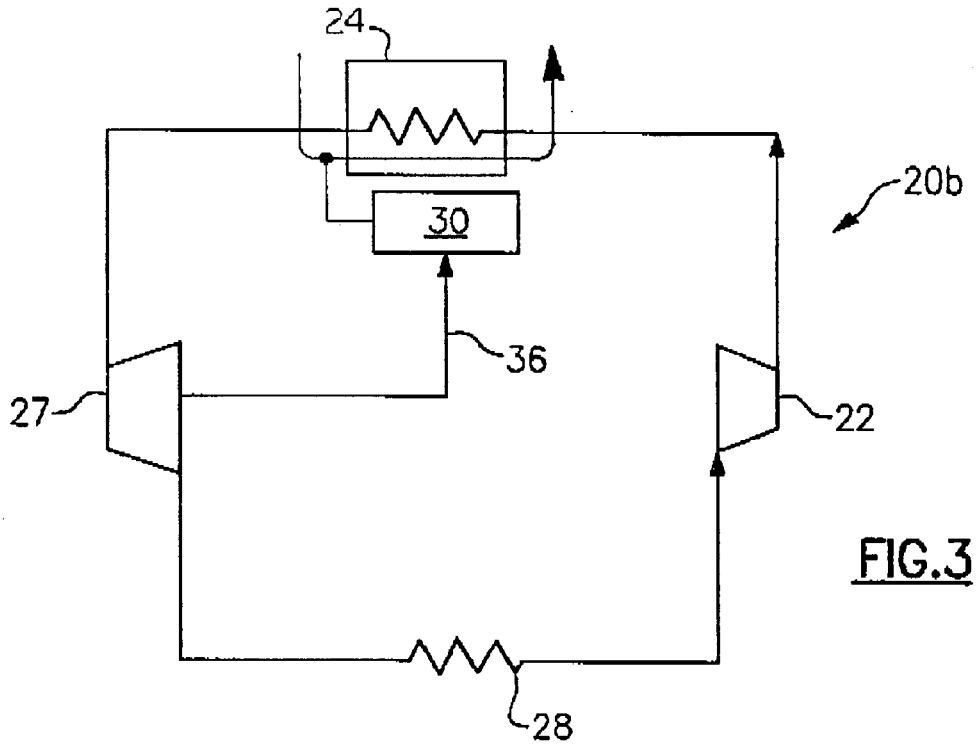
FIG. 3 illustrates a schematic diagram of the transcritical vapor compression system of the present invention including an expansion device that is coupled to a fluid pumping device that pumps refrigerant through a gas cooler.

FIG. 3 schematically illustrates the transcritical vapor compression system 20*b* of the present invention including an expansion machine 27. An expansion machine 27 is a work recovery device which extracts energy from the expansion process and makes the system 20*b* more efficient due to a more isentropic expansion process and the efficient use of the extracted energy. The amount of energy available for extraction by the expansion machine 27 is generally proportional to the pressure drop across the expansion machine 27, or the pressure drop between the gas cooler 24 and the evaporator 28.

As shown in FIG. 3, the expansion machine 27 is coupled with a fluid pumping device 30. The expansion machine 27 can be linked to the fluid pumping device 30 either mechanically or electrically. In one example, the expansion machine 27 and the fluid pumping device 30 are linked by a shaft 36. The fluid pumping device 30 pumps the fluid that exchanges heat to cool the refrigerant flowing through the gas cooler 24. If the fluid that exchanges heat with the refrigerant in the gas cooler 24 is air, the fluid pumping device 30 is generally a fan or blower. If the fluid that exchanges heat with the refrigerant in the gas cooler 24 is a liquid, the fluid pumping device 30 is generally a pump.

The fluid pumping device 30 pumps fluid through the gas cooler 24 at a rate related to the energy extracted from the expansion machine 27 during the expansion process. As more energy is extracted, the flowrate of the fluid flowing through the fluid pumping device 30 increases. Conversely, as less energy is extracted during the expansion process, the flow rate of the fluid flowing through the fluid pumping device decreases.

The system 20*b* provides a self-controlling mechanism to regulate the high pressure of the refrigerant in the gas cooler 24. As the high pressure in the gas cooler 24 increases, the expansion machine 27 extracts more energy from the expansion process. More energy is extracted from the expansion process as there is a greater pressure drop between the high pressure in the gas cooler 24 and the low pressure in the evaporator 28, resulting in a greater pressure drop across the expansion machine 27. This increase in extracted energy increases the flowrate of the fluid pumping device 30, and more fluid is pumped across the gas cooler 24. As more fluid pumps across the gas cooler 24, the heat transfer between the fluid and the refrigerant increases, and the temperature of the refrigerant in the gas cooler 24 decreases. As the temperature of the refrigerant in the gas cooler 24 decreases, the pressure of the refrigerant in the gas cooler 24 decreases.

Conversely, as the high pressure in the gas cooler 24 decreases, the expansion machine 27 extracts less energy from the expansion process. Less energy is extracted from the expansion process as there is a lower pressure drop between the high pressure in the gas cooler 24 and the low pressure in the evaporator 28, resulting in a lower pressure drop across the expansion machine 27. This decrease in extracted energy decreases the flowrate of the fluid pumping device 30, and less fluid is pumped across the gas cooler 24. As less fluid pumps across the gas cooler 24, the heat transfer between the fluid and the refrigerant decreases, and the temperature of the refrigerant in the gas cooler 24 increases. As the temperature of the refrigerant increases, the pressure of the refrigerant in the gas cooler 24 increases.

The system 20*b* provides for the automatic self-control of the high pressure of the refrigerant in the gas cooler 24. As the high pressure changes, the flowrate of the fluid pumping device 30 changes, modifying the heat transfer between the refrigerant and the fluid and therefore the high pressure of the refrigerant in the gas cooler 24.

The expansion machine 27 and the fluid pumping device 30 do not need to be directly linked by the shaft 36. The power from the expansion machine 27 can be transmitted to the fluid pumping device 30 through a generator and motor.

Figure 4:
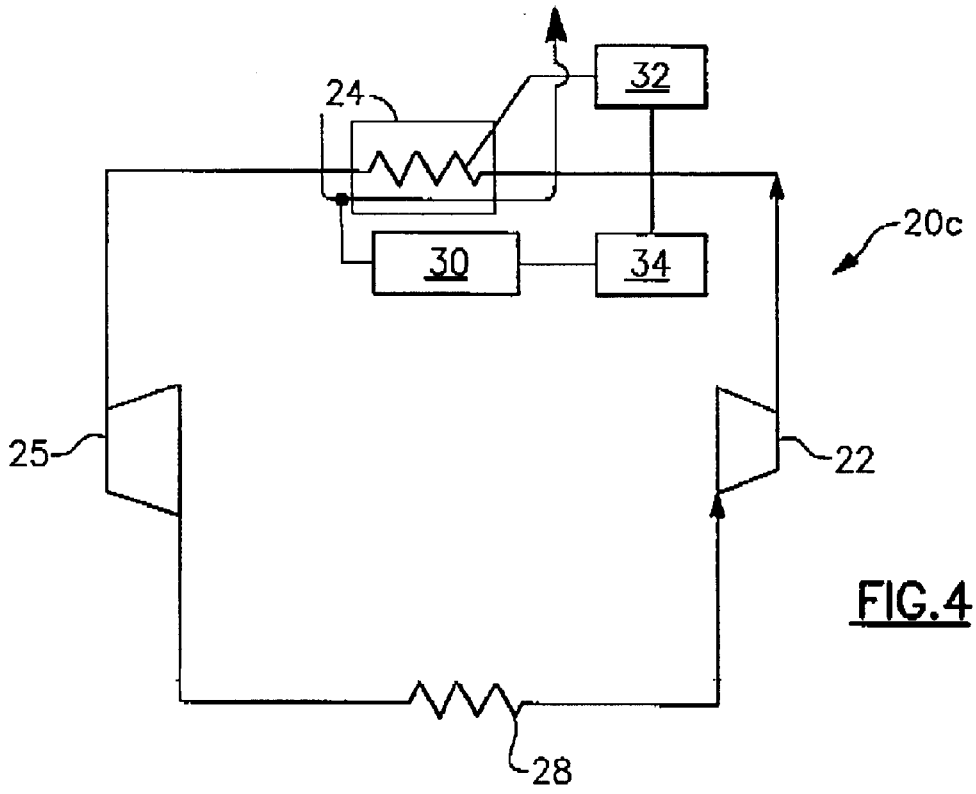
FIG. 4 illustrates a schematic diagram of the transcritical vapor compression system of the present invention including a fluid pumping device that is coupled to a motor.

As illustrated in FIG. 4, the flow rate of the fluid flowing through the fluid pumping device 30 can also be directly controlled by a motor 34, allowing for regulation of the high pressure in the gas cooler 24. A control 32 monitors the high pressure in the gas cooler 24. In this example, the expansion device 25 can be either an expansion valve, as in FIG. 1, or an expansion machine, as in FIG. 3.

If the control 32 detects an increase in the high pressure in the gas cooler 24, the control 32 actuates the fluid pumping device 30 to increase its flowrate and increase the flow rate of fluid flowing across the gas cooler 24 that exchanges heat with the refrigerant flowing through the gas cooler 24. As more fluid pumps across the gas cooler 24, the heat transfer between the fluid and the refrigerant increases, and the temperature of the refrigerant in the gas cooler decreases 24. As the temperature of the refrigerant decreases, the pressure of the refrigerant in the gas cooler 24 decreases.

Conversely, if the control 32 detects a decrease in the high pressure in the gas cooler 24, the control 32 actuates the fluid pumping device 30 to decrease its flowrate and decrease the flow rate of fluid flowing across the gas cooler 24 that exchanges heat with the refrigerant flowing through the gas cooler 24. As less fluid pumps across the gas cooler 24, the heat between the fluid and the refrigerant decreases, and the temperature of the refrigerant in the gas cooler 24 increase. As the temperature of the refrigerant increases, the pressure of the refrigerant in the gas cooler 24 increases.

The foregoing description is only exemplary of the principles of the invention. Many modification and variation of the present invention are possible in light of the above teaching. The preferred embodiments of this invention have been disclosed, however, so that one of ordinary skill in the art would recognize that certain modification would come within the scope of this invention. It is, therefore, to be understood that within the scope of the appended claims, the invention may be practiced otherwise than as specifically described. For that reason the following claims should be studied to determine the true scope and content of this invention.

What is claimed is:

1. A transcritical vapor compression system comprising:

a compression device to compress a refrigerant to a high pressure;

a heat rejecting heat exchanger for cooling said refrigerant;

a fluid pumping device to pump a fluid at a pumping flowrate, said fluid exchanging heat with said refrigerant in said heat rejecting heat exchanger and adjustment of said pumping flowrate of said fluid regulates said high pressure in said system;

an expansion device for reducing said refrigerant to a low pressure;

and said expansion device is linked to said fluid pumping device;

a sensor to sense said high pressure of the system;

a motor to adjust said pumping flowrate of said fluid pumping device based on said high pressure sensed by said sensor; and a heat accepting heat exchanger for evaporating said refrigerant.

2. The system as recited in claim 1 wherein said pumping flowrate of said fluid pumping device is related to said pressure difference between said high pressure and said low pressure of the system.

3. The system as recited in claim 1 wherein said expansion device is an expansion valve.

4. The system as recited in claim 1 wherein said motor increases said pumping flowrate when said sensor detects an increase in said high pressure to decrease said high pressure of the system to a desired high pressure.

5. The system as recited in claim 1 said motor decreases said pumping flowrate when said sensor detects a decrease in said high pressure to increase said high pressure of the system to a desired high pressure.

6. A transcritical vapor compression system comprising:

a compression device to compress a refrigerant to a high pressure;

a heat rejecting heat exchanger for cooling said refrigerant;

a fluid pumping device to pump a fluid at a pumping flowrate said fluid exchanging heat with said refrigerant in said heat rejecting heat exchanger and adjustment of said pumping flowrate of said fluid regulates said high pressure in said system;

an expansion machine for reducing said refrigerant to a low pressure, and said fluid pumping device is linked to said expansion machine; and a heat accepting heat exchanger for evaporating said refrigerant.

7. The system as recited in claim 6 wherein said fluid pumping device is mechanically linked to said expansion machine.

8. The system as recited in claim 6 wherein said fluid pumping device is electrically linked to said expansion machine.

9. The system as recited in claim 6 wherein said expansion machine extracts an amount of energy, and said pumping flowrate of said fluid pumping device is related to said amount of energy.

10. The system as recited in claim 9 wherein said amount of energy extracted is generally related to a difference between said high pressure and said low pressure of the system.

11. The system as recited in claim 9 wherein said expansion machine extracts an increase in said amount of energy when said high pressure increases, increasing said pumping flowrate of said fluid pumping device, decreasing a temperature of said refrigerant in said heat rejecting heat exchanger and decreasing said high pressure of the system.

12. The system as recited in claim 7 wherein said expansion machine extracts a decrease in said amount of energy when said high pressure decreases, decreasing said pumping flowrate of said fluid pumping device, increasing a temperature of said refrigerant in said heat rejecting heat exchanger and increasing said high pressure of the system.

13. The system as recited in claim 6 wherein said expansion machine and said fluid pumping device are coupled by a shaft.

14. The system as recited in claim 6 wherein said refrigerant is carbon dioxide.

15. The system as recited in claim 6 wherein said fluid pumping device is one of a fan and a blower when said fluid is a vapor.

16. The system as recited in claim 6 wherein said fluid pumping device is a pump when said fluid is a liquid.

17. A method of regulating a high pressure of a transcritical vapor compression system comprising the steps of:

compressing a refrigerant to said high pressure;

cooling said refrigerant by exchanging heat with a fluid;

pumping said fluid at a pumping flowrate;

adjusting said pumping flowrate of said fluid to regulate said high pressure;

expanding said refrigerant to a low pressure;

coupling the step of expanding with the step of pumping; and evaporating said refrigerant.

18. A method of regulating a high pressure of a transcritical vapor compression system comprising the steps of:

compressing a refrigerant to said high pressure;

sensing said high pressure of the system;

cooling said refrigerant by exchanging heat with a fluid;

pumping said fluid at a pumping flowrate;

adjusting said pumping flowrate of said fluid based on the step of sensing to regulate said high pressure;

expanding said refrigerant to a low pressure "coupling the step of expanding with the step of pumping;" and evaporating said refrigerant.

* * * * *

UNITED STATES PATENT AND TRADEMARK OFFICE

CERTIFICATE OF CORRECTION

PATENT NO. : 6,739,141 B1
DATED : May 25, 2004
INVENTOR(S) : Sienel et al.

It is certified that error appears in the above-identified patent and that said Letters Patent is hereby corrected as shown below:

Column 5,
Line 7, please insert -- wherein -- after “claim 1” and before “said”.

Column 6,
Lines 38 and 39, please delete “″” before “coupling” and after “pumping;”.

Signed and Sealed this

Seventeenth Day of August, 2004

JON W. DUDAS
*Acting Director of the United States Patent and Trademark Office*